US006874283B1

(12) United States Patent
Hindle

(10) Patent No.: US 6,874,283 B1
(45) Date of Patent: Apr. 5, 2005

(54) STATIONARY BUILDING CONSTRUCTION WITH MOVABLE SHUTTLE SECTION

(76) Inventor: William A. Hindle, 1705 County Rd. 519, Everittstown, NJ (US) 08868

( * ) Notice: Subject to any disclaimer, the term of this patent is extended or adjusted under 35 U.S.C. 154(b) by 7 days.

(21) Appl. No.: 10/326,741

(22) Filed: Dec. 20, 2002

(51) Int. Cl.[7] ..... E04B 1/346
(52) U.S. Cl. ..... 52/67; 52/64; 296/26.12; 296/26.13; 296/26.14; 296/165
(58) Field of Search ..... 52/67, 64; 296/26.12, 296/26.13, 26.14, 165, 171, 172, 175

(56) References Cited

U.S. PATENT DOCUMENTS

| | | | | |
|---|---|---|---|---|
| 2,499,498 | A | | 3/1950 | Hammond, Jr. |
| 2,692,161 | A | | 10/1954 | Van Tassel |
| 2,877,509 | A | | 3/1959 | Klibanow |
| 2,902,312 | A | | 9/1959 | Ferrera |
| 3,512,315 | A | | 5/1970 | Vitalini |
| 3,645,052 | A | | 2/1972 | Hanna |
| 3,653,165 | A | | 4/1972 | West |
| 3,778,100 | A | | 12/1973 | Dillard |
| 4,133,571 | A | | 1/1979 | Fillios |
| 4,180,949 | A | | 1/1980 | Draper, Jr. |
| 4,413,855 | A | | 11/1983 | Flanagan |
| RE32,262 | E | | 10/1986 | Stewart |
| 4,689,924 | A | | 9/1987 | Jurgensen |
| 4,785,590 | A | | 11/1988 | Jones |
| 4,817,345 | A | | 4/1989 | McGlew |
| 5,061,006 | A | | 10/1991 | Baughman |
| 5,237,782 | A | * | 8/1993 | Cooper ..... 52/67 |
| 5,248,180 | A | | 9/1993 | Hussaini |
| 5,291,701 | A | | 3/1994 | Delacollette et al. |
| 5,332,276 | A | | 7/1994 | Blodgett, Jr. |
| 5,333,402 | A | | 8/1994 | Weir |
| 5,345,730 | A | | 9/1994 | Jurgensen |
| 5,384,992 | A | | 1/1995 | Roberton |
| 5,491,933 | A | | 2/1996 | Miller et al. |
| 5,577,351 | A | | 11/1996 | Dewald, Jr. et al. |
| 5,586,802 | A | | 12/1996 | Dewald, Jr. et al. |
| 5,706,612 | A | | 1/1998 | Tillett |
| 5,784,849 | A | | 7/1998 | DeVon et al. |
| 5,787,650 | A | | 8/1998 | Miller et al. |
| 5,788,306 | A | | 8/1998 | DiBiagio et al. |
| 5,791,715 | A | | 8/1998 | Nebel |
| 5,902,001 | A | | 5/1999 | Schneider |
| 6,048,016 | A | | 4/2000 | Futrell et al. |
| 6,052,952 | A | | 4/2000 | Frerichs et al. |

(Continued)

*Primary Examiner*—Kimberly T. Wood
(74) *Attorney, Agent, or Firm*—Sperry, Zoda & Kane

(57) ABSTRACT

A stationary building structure having a sidewall opening with a shuttle section movable through the opening to an extended position or movable over the opening for closing thereof. The shuttle section includes a frame which defines a shuttle floor surface thereabove. A shuttle tail extends from the shuttle frame into the stationary building structure for supporting the shuttle section at all times whether in the extended position, the retracted position or moving therebetween. An outer shuttle wall extends upwardly from the frame for closing the sidewall opening of the stationary building when the shuttle is retracted. A sealing means is defined on the outer wall for engaging the building around the sidewall opening for selectively sealing thereof when in the retracted position. A drive mechanism is mounted to the stationary building structure and is operatively secured to the shuttle section for urging movement thereof between the respective positions.

21 Claims, 6 Drawing Sheets

U.S. PATENT DOCUMENTS 6,059,339 A 5/2000 Madson
6,067,756 A 5/2000 Frerichs et al.
6,094,870 A 8/2000 Stacy
6,108,983 A 8/2000 Dewald, Jr. et al.
6,109,683 A 8/2000 Schneider
6,176,045 B1 1/2001 McManus et al.
6,182,401 B1 2/2001 McManus et al.
6,266,931 B1 7/2001 Erickson et al.
6,286,883 B1 9/2001 Schneider et al.
6,293,611 B1 9/2001 Schneider et al.

* cited by examiner

STATIONARY BUILDING CONSTRUCTION WITH MOVABLE SHUTTLE SECTION

BACKGROUND OF THE INVENTION

1. Field of the Invention

The present invention deals with the field of building construction generally and in particular deals with those stationary building constructions having movable rooms or movable room sections for varying the configuration of the living accommodations thereof. More particularly the present invention relates to stationary building structures having a room portion extendable outwardly away therefrom to increase the living space of a particular room or section thereof or to provide open air access to the external environment for enhanced ambience and exposure to an open air living environment.

2. Description of the Prior Art

Extendable living spaces are more commonly utilized for mobile living environments such as mobile trailers, tents, pop-up camping equipment, mobile homes and recreational vehicles which include extended living spaces. The present invention provides a unique example of a living section of a room which can shuttle inwardly and outwardly within a stationary building construction. Examples of relevant prior art configurations include U.S. Pat. No. 2,499,498 patented Mar. 7, 1950 to J. H. Hammond, Jr. on a "Mobile Housing Unit"; and U.S. Pat. No. 2,692,161 patented Oct. 19, 1954 to J. Van Tassel and assigned to Alert Development Corporation on a "Multiple-Room Expansible House Trailer"; and U.S. Pat. No. 2,877,509 patented Mar. 17, 1959 to D. W. Klibanow on "Trailer Constructions"; and U.S. Pat. No. 2,902,312 patented Sep. 1, 1959 to J. Ferrera on an "Expansible House Trailer"; and U.S. Pat. No. 3,512,315 patented May 19, 1970 to A. Vitalini on a "Building Having Telescopic Section"; and U.S. Pat. No. 3,645,052 patented Feb. 29, 1972 to P. R. Hanna and assigned to Vantrex on "Modular Building Structures And Certain Movable Components Therefor"; and U.S. Pat. No. 3,653,165 patented Apr. 4, 1972 to C. A. West on an "Expandable Building With Telescoping Enclosures And Hingedly Connected Barriers"; and U.S. Pat. No. 3,778,100 patented Dec. 11, 1973 to P. A. Dillard on an "Expandable Room For Portable Living Quarters"; and U.S. Pat. No. 4,133,571 patented Jan. 9, 1979 to F. T. Fillios on an "Expandable Camper Body"; and U.S. Pat. No. 4,180,949 patented Jan. 1, 1980 to E. S. Draper, Jr. on a "Transportable-Expandable Mobile Home Structure"; and U.S. Pat. No. 4,413,855 patented Nov. 8, 1983 to F. Flanagan on a "Sliding Patio For Travel Trailers And Mobile Homes"; and U.S. Reissue Pat. No. Re.32,262 patented to B. B. Stewart on Oct. 7, 1986 on a "Telescoping Room For Travel Trailers"; and U.S. Pat. No. 4,689,924 patented Sep. 1, 1987 to B. A. Jurgensen on an "Expandable Structure And Sequence Of Expansion"; and U.S. Pat. No. 4,785,590 patented Nov. 22, 1988 to P. R. Jones on an "Enclosure With Telescoping Walls"; and U.S. Pat. No. 4,817,345 patented Apr. 4, 1989 to J. J. McGlew on a "Building Having Movable Restaurant"; and U.S. Pat. No. 5,061,006 patented Oct. 29, 1991 to M. Baughman on a "Method For Expandable Sleeping Compartments For Vehicles"; and U.S. Pat. No. 5,248,180 patented Sep. 28, 1993 to S. M. Hussaini and assigned to The United States of America as represented by the Secretary of the Army on an "Expandable Enclosure"; and U.S. Pat. No. 5,291,701 patented Mar. 8, 1994 to M. Delacollette et al and assigned to Espace Mobile International S.A. on an "Extendible Rigid Construction"; and U.S. Pat. No. 5,332,276 patented Jul. 26, 1994 to R. W. Blodgett, Jr. on a "Cable-Driven Extension Mechanism For Trailer Slide-Out" ; and U.S. Pat. No. 5,333,402 patented Aug. 2, 1994 to H. J. Weir and assigned to Wecotec, Ltd. on a "Sheet Corner Transfer System"; and U.S. Pat. No. 5,345,730 patented Sep. 13, 1994 to B. A. Jurgensen on an "Expandable Structure And Sequence Of Expansion"; and U.S. Pat. No. 5,384,992 patented Jan. 31, 1995 to I. Roberton on an "Apparatus For Extending An Enclosure"; and U.S. Pat. No. 5,491,933 patented Feb. 20, 1996 to M. A. Miller et al and assigned to Mahlon A. Miller on a "Flat Floor Slide Out Apparatus For Expandable Rooms"; and U.S. Pat. No. 5,577,351 patented Nov. 26, 1996 to J. E. Dewald, Jr. et al on a "Slide Out Room With Flush Floor"; and U.S. Pat. No. 5,586,802 patented Dec. 24, 1996 to J. E. Dewald, Jr. et al on a "Linkage For Guiding A Retractable Room"; and U.S. Pat. No. 5,706,612 patented Jan. 13, 1998 to B. E. Tillett and assigned to Peterson Industries, Inc. on a "Self Leveling Flush Slide-Out Floor"; and U.S. Pat. No. 5,784,849 patented Jul. 28, 1998 to D. L. DeVon et al and assigned to Banks Lumber Company, Inc. on a "Floor Frame Assembly"; and U.S. Pat. No. 5,787,650 patented Aug. 4, 1998 to M. A. Miller et al and assigned to Newmar Corporation on a "Flat Floor Slide Out Apparatus For Expandable Rooms"; and U.S. Pat. No. 5,788,306 patented Aug. 4, 1998 to A. J. DiBiagio et al and assigned to Monaco Coach Corporation on a "Trailer Slideout Mechanism"; and U.S. Pat. No. 5,791,715 patented Aug. 11, 1998 to M. W. Nebel on an "Extension Mechanism For Travel Trailer Slide-Out Rooms"; and U.S. Pat. No. 5,902,001 patented May 11, 1999 to R. H. Schneider and assigned to Applied Power, Inc. on an "Expandable Room Flat Floor System Utilizing Notched Inner Rails And Ramped Outer Rails"; and U.S. Pat. No. 6,048,016 patented Apr. 11, 2000 to S. D. Futrell et al and assigned to Winnebago Industries, Inc. on a "Vehicle With Slide-Out Room"; and U.S. Pat. No. 6,052,952 patented Apr. 25, 2000 to M. E. Frerichs et al and assigned to HWH Corporation on a "Flat Floor Room Extension"; and U.S. Pat. No. 6,059,339 patented May 9, 2000 to H. G. Madson on a "Cantileverly Extendible Platform"; and U.S. Pat. No. 6,067,756 patented May 30, 2000 to M. E. Frerichs et al and assigned to HWH Corporation on a "Space Saving Room Extender"; and U.S. Pat. No. 6,094,870 patented Aug. 1, 2000 to R. W. Stacy and assigned to QC Metal Fab, Inc. on a "Locking Device For Slide-Out Rooms"; and U.S. Pat. No. 6,108,983 patented Aug. 29, 2000 to J. E. Dewald, Jr. et al on a "Slide Out Room With Flush Floor"; and U.S. Pat. No. 6,109,683 patented Aug. 29, 2000 to R. H. Schneider and assigned to Applied Power, Inc. on a "Flush Floor Slide-Out Room Support System"; and U.S. Pat. No. 6,176,045 patented Jan. 23, 2001 to P. W. McManus et al on a "Retractable Room Support Mechanism"; and U.S. Pat. No. 6,182,401 patented Feb. 6, 2001 to P. W. McManus et al on a "Retractable Room Support Mechanism"; and U.S. Pat. No. 6,266,931 patented Jul. 31, 2001 to J. S. Erickson et al and assigned to Atwood Industries, Inc. on a "Screw Drive Room Slideout Assembly"; and U.S. Pat. No. 6,286,883 patented Sep. 11, 2001 to R. H. Schneider et al and assigned to Applied Power Inc. on a "Drop Room Flat Floor System Employing Biasing And Cushioning Arrangement"; and U.S. Pat. No. 6,293,611 patented Sep. 25, 2001 to R. H. Schneider et al and assigned to Actuant Corporation on a "Flush Floor Slide-Out Room Support System".

SUMMARY OF THE INVENTION

The building construction apparatus of the present invention includes a stationary building structure which includes a sidewall opening defined therein. A stationary support such as an I-beam is fixedly mounted to the building and extends generally in a perpendicular direction with respect to the plane of the sidewall opening. This stationary support or I-beam preferably includes an upper support wall fixedly secured to the stationary building as well as a lower support wall fixedly secured to the stationary building at a position below the upper support wall means and a lateral support wall means extending generally vertically between the upper support wall and the lower support wall. In those configurations where the stationary support comprises an I-beam the vertical panel member on the I-beam will define the lateral support wall and the top horizontal panel member on the I-beam which is integral with the upper portion of the vertically extending panel member will define an upper support wall extending therealong. Also a bottom horizontal panel member will be included which is the lower portion of the I-beam being integral with the lower portion of the vertical panel member of the I-beam and in this manner will define the lower support wall extending therealong.

The building construction apparatus will include a shuttle section movably secured thereto and extendable outwardly therefrom through a sidewall opening defined therein in order to selectively provide an aesthetic open air living area. The shuttle section preferably includes a shuttle frame movably secured to the stationary building structure and adapted to be extendable generally horizontally outwardly therefrom through the sidewall opening to an extended position with respect thereto to define open air exposure therefor outside of the stationary building construction. The shuttle frame can also be movable into the stationary building structure through the sidewall opening to a retracted position to facilitate conventional use of the stationary building structure.

The shuttle section will include a shuttle floor surface fixedly secured to and positioned upon the shuttle frame to define a walking surface thereupon. The shuttle section will also preferably include a shuttle tail member which is integrally formed with the shuttle frame preferably to be fixedly secured thereto and movable therewith. This shuttle tail member will be adapted to extend into the stationary building structure from the shuttle frame responsive to positioning thereof at the retracted position and at the extended position and during movement therebetween. In this manner the shuttle tail member will always be positioned within the stationary building structure to provide support for the shuttle frame and shuttle floor which extend outwardly from the stationary building through the opening.

An outer shuttle wall may be included extendable upwardly from the shuttle frame which is adapted to extend across the sidewall opening of the stationary building structure responsive to the shuttle frame being positioned in the retracted position. Also an outer wall sealing means may be positioned peripherally around the outer shuttle wall for sealing thereof with respect to the stationary building structure around the sidewall opening defined therein when the movable shuttle section is in the retracted position. The outer wall seal will preferably define at least one outer receiving channel extending therearound and will include at least one outer protruding rib member extending therearound. The outer wall seal will also include a V-shaped outer guide mechanism positioned within the outer receiving channel to facilitate in the guiding of sealing engagement therewith.

A drive mechanism may be included operatively connected with respect to the shuttle frame for selectively urging movement thereof between the retracted position and the extended position respectively. This drive mechanism preferably will include a rack gear secured to the shuttle frame and extending therealong. The drive mechanism also will preferably include a drive gear movably secured to the stationary building structure and positioned in engagement with respect to the rack gear to cause driving movement thereof and driving movement of the shuttle frame selectively between the extended and retracted positions. Also the drive mechanism will preferably include a driveshaft which is attached to the drive gear for selectively urging rotational movement thereof. A drive means which is selectively operable will be fixedly secured to the stationary building structure and will be operatively attached with respect to the driveshaft for urging rotational movement thereof. The drive means is responsive to selective operation thereof to rotate the driveshaft and the drive gear for powering movement of the rack gear to cause the shuttle section to selectively move between the retracted position and the extended position, respectively.

The shuttle section will also preferably include a tail support member fixedly secured to the shuttle tail member to be movable therewith to facilitate support of the shuttle tail member responsive to positioning thereof at the extended position and at the retracted position and at all times during movement therebetween. This tail support member preferably will include an upper bearing extending upwardly from the tail support and adapted to abut and follow the upper support wall to facilitate supporting of the shuttle section during movement thereof between the extended and retracted positions. The upper bearing may preferably include an upper roller rotatably mounted with respect to the tail support member and in abutment with respect to the upper support wall. The upper roller preferably will define an upper axis of rotation thereof which extends approximately horizontally.

The tail support member preferably will also include a lower bearing extending downwardly therefrom which is adapted to abut and follow the lower support wall to facilitate supporting of the shuttle during movement thereof between the extended and retracted positions. This lower bearing will preferably include a lower roller rotatably mounted with respect to the tail support member and positioned in abutment with respect to the lower support wall. The lower roller will preferably define a lower axis of rotation which extends generally horizontally. Additionally the tail support member will include a lateral bearing means extending laterally outwardly from the tail member and adapted to engage and follow the lateral support wall to facilitate lateral support of the shuttle during movement thereof between the extended and retracted positions and prevent lateral shifting thereof during this movement. This lateral bearing will preferably include a lateral roller rotatably mounted with respect to the tail support member and in abutment with respect to the lateral support wall. This lateral roller will define a lateral axis of rotation for extending generally in a vertically extending direction.

A primary bearing will be included mounted on the stationary building structure adjacent the lower portion of the sidewall opening beneath the shuttle frame for supporting thereof relative to the stationary building structure and to facilitate movement thereof between the extended and retracted positions, respectively. The primary bearing will preferably include a primary roller rotatably secured to the stationary building structure and in abutment with respect to the shuttle frame located thereabove for guiding and supporting movement thereof between the extended position and the retracted position, respectively.

A stationary wall seal will preferably be included extending peripherally around the sidewall opening positioned on the outer portion of the stationary building structure therearound. This seal is preferably configured to complement and engage the outer wall seal to facilitate sealing between the outer shuttle wall and the stationary building structure surrounding the sidewall opening thereof. The stationary wall seal will define a stationary receiving channel extending therearound and include at least one stationary protruding rib extending therearound. This stationary receiving channel will be adapted to engage the outer protruding rib therewithin and the outer receiving channel will be adapted to engage the stationary protruding rib therewithin in order to facilitate sealing engagement between the stationary wall seal and the outer wall seal responsive to the shuttle section being located in the retracted position. The stationary wall seal will preferably include a V-shaped stationary guide positioned within the stationary receiving channel to facilitate guiding and sealing engagement between the outer protruding rib and the stationary receiving channel responsive to movement of the shuttle frame to the retracted position. The stationary protruding rib will be adapted to abut the V-shaped outer guide to facilitate guiding movement thereof into sealing engagement with respect to the outer receiving channel. A collapsible guard rail will preferably be included attached to the shuttle frame which is movable to a deployed position responsive to movement of the shuttle frame from the retracted position toward the extended position and being movable to a storage position responsive to movement of the shuttle frame to the retracted position. A lateral shuttle wall may also be included extending upwardly from the shuttle frame. This lateral shuttle wall will preferably be fixedly secured to the shuttle frame for simultaneous movement therewith. The shuttle wall will preferably be positioned adjacent to the outer wall and also be movable therewith and extend from the outer wall inwardly toward the stationary building structure such as to be movable therein through the sidewall opening responsive to movement of the shuttle section to the retracted position.

It is an object of the building construction apparatus of the present invention to provide a shuttle section which is movable with respect to a stationary building structure.

It is an object of the building construction apparatus of the present invention to provide a shuttle section movable between a retracted position for conventional stationary building usage at an extended position providing open air living during good weather conditions.

It is an object of the building construction apparatus of the present invention to provide an apparatus having minimum moving parts and which is easily maintained.

It is an object of the building construction apparatus of the present invention to provide a movable living space which is of limited initial capital cost outlay.

It is an object of the building construction apparatus of the present invention to provide full support thereof by the positioning of multiple I-beams within the stationary building structure thereof.

It is an object of the building construction apparatus of the present invention to provide a sidewall opening in a stationary building which can be opened to allow a portion of the adjacent room to extend outwardly for aesthetic purposes.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
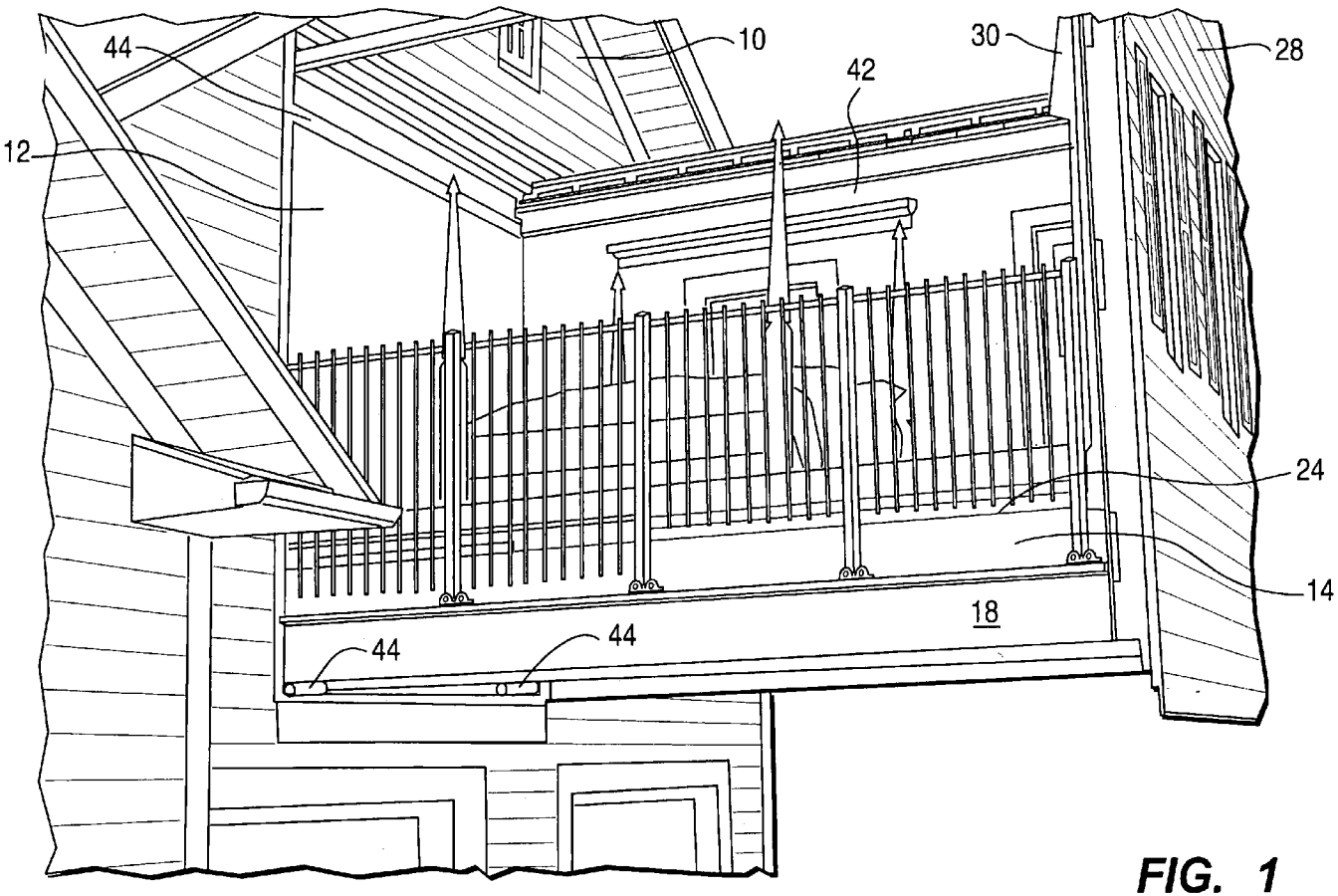
FIG. 1 is a perspective illustration of an embodiment of the building construction apparatus of the present invention shown in the extended position.

As shown in the drawings the present application shows a building construction apparatus having a stationary building structure 10 with a sidewall opening 12 defined therein. A shuttle section 14 is movable through the sidewall opening 12 between an extended position 20 and a retracted position 22.

The shuttle frame 18 defines a shuttle floor surface 24 on the upper surface thereof for facilitating walking thereupon when the shuttle section 14 is in either the extended or retracted positions 20 or 22 respectively.

An outer shuttle wall 28 will be preferably fixedly secured with respect to the shuttle frame 18 to extend thereabove and define an outer wall for the shuttle section 14. When the shuttle section 14 is in the retracted position 22 the outer shuttle wall 28 will extend over and close the sidewall opening 12 defined in the stationary building structure 10. On the otherhand when the shuttle section 14 is in the extended position 20 the outer shuttle wall 28 will be positioned spatially distant from the stationary building structure 10 and the sidewall opening 12 defined therein to define an open air living area for individuals located upon the shuttle floor surface 24 or other furniture located thereon.

The shuttle section 14 preferably includes a shuttle frame 18 which is a secure stable platform holding the shuttle floor surface 24 in the extended position 20 in a fully reinforced and strengthened position. A shuttle tail member 26 will preferably be fixedly secured with respect to the shuttle section 14 and preferably be integral therewith. As shown in the figures of the present invention the overall structural strength of the shuttle frame 18 and the shuttle tail member 26 can be significantly enhanced by the use of longitudinally extending I-beams.

An outer wall sealing means 30 is preferably positioned about the interfacing surface of the outer periphery of the outer shuttle wall 28 and is adapted to engage the stationary building structure 10 in the area thereof immediately surrounding the sidewall opening 12 for sealing the outer shuttle wall 28 with respect to the stationary building structure 10 when the shuttle section 14 is in the retracted position 22. To further facilitate this sealing a stationary wall seal 46 may be positioned on the stationary building structure 10 about the outer periphery of the sidewall opening 12. Preferably the stationary wall seal 46 will be engageable with respect to the outer wall seal 30 of the outer shuttle wall 28 for the purposes of being mutually complementing and forming a more effective and efficient seal at the intersection between the stationary building structure 10 and the outer shuttle wall 28 when the shuttle frame 18 is in the closed position.

Movement of the shuttle section 14 between the extended position 20 and the retracted position 22 is powered preferably by a drive mechanism 32. In a preferred configuration drive mechanism 32 includes a rack gear 34 which extends along one or both sides of the undersurface of the shuttle frame 18. A drive means 40 is mounted to the stationary building structure 10 and includes one or more driveshafts 38 extending outwardly therefrom. As shown best in FIG. 3 the driveshafts 38 extend outwardly from drive means 40 in both directions. A drive gear 36 is mounted to one or both driveshafts 38 and is positioned in engagement with respect to a rack gear 34 thereadjacent. As such, operation of drive means 40 will cause rotational driveshafts 38 and similar rotation of drive gears 36 causing movement of the shuttle frame 18 between the extended position 20 and the retracted position 22, respectively, because the rack gear 34 is fixedly secured with respect to the shuttle frame 18. With a shuttle frame 18 formed of I-beams the rack gears 34 will normally be fixedly secured to the undersurface of the I-beam to facilitate movement of the shuttle section 14 between the relative positions as well as assuring positive engagement between the rack gears 34 and the drive gears 36.

A substantial amount of weight of the shuttle frame 18 will be exerted downwardly upon the upper edge of the side wall opening 12 defined in stationary building structure 10. For this reason a primary bearing means 44 preferably comprising a roller mechanism immediately above each opposite lateral edge of the lower periphery of the side wall opening is preferred. This primary bearing 44 will support the shuttle section 14 as well as all furniture or persons positioned upon the shuttle floor surface 24. The primary bearing means 44 preferably comprises one or two rollers on each opposite corner of the side wall opening 12 immediately below the shuttle frame 18.

In the preferred configuration of the present invention a lateral shuttle wall 42 will extend upwardly and be perpendicularly oriented with respect to the outer shuttle wall 28. It is preferred that only one such lateral shuttle wall 42 be included in order to enhance the overall open air living aesthetic appearance of the design.

The configuration of the shuttle tail member 26 of the present invention is an important consideration. As shown best in FIG. 2 this tail section will extend into the stationary building structure 10 at all times regardless of the position of the shuttle frame 18. Even when the shuttle frame 18 is in the outermost extended position 20 the shuttle tail member 26 will still be located within the stationary building structure 10 on the inside of the sidewall opening 12. This shuttle tail member 26 provides the leverage for supporting the relatively heavy weight of the shuttle frame 18 when positioned in locations close to the extended position 20 or in the completely extended position 20. This operation of the shuttle tail member 26 is an important consideration of the present invention and it is important that the shuttle tail member 26 be firmly supported and easily movable relative to the stationary building structure 10 while at the same time extending thereinto sufficiently to amply and completely support the entire shuttle section 14 especially when at the extended position 20.

Figure 2:
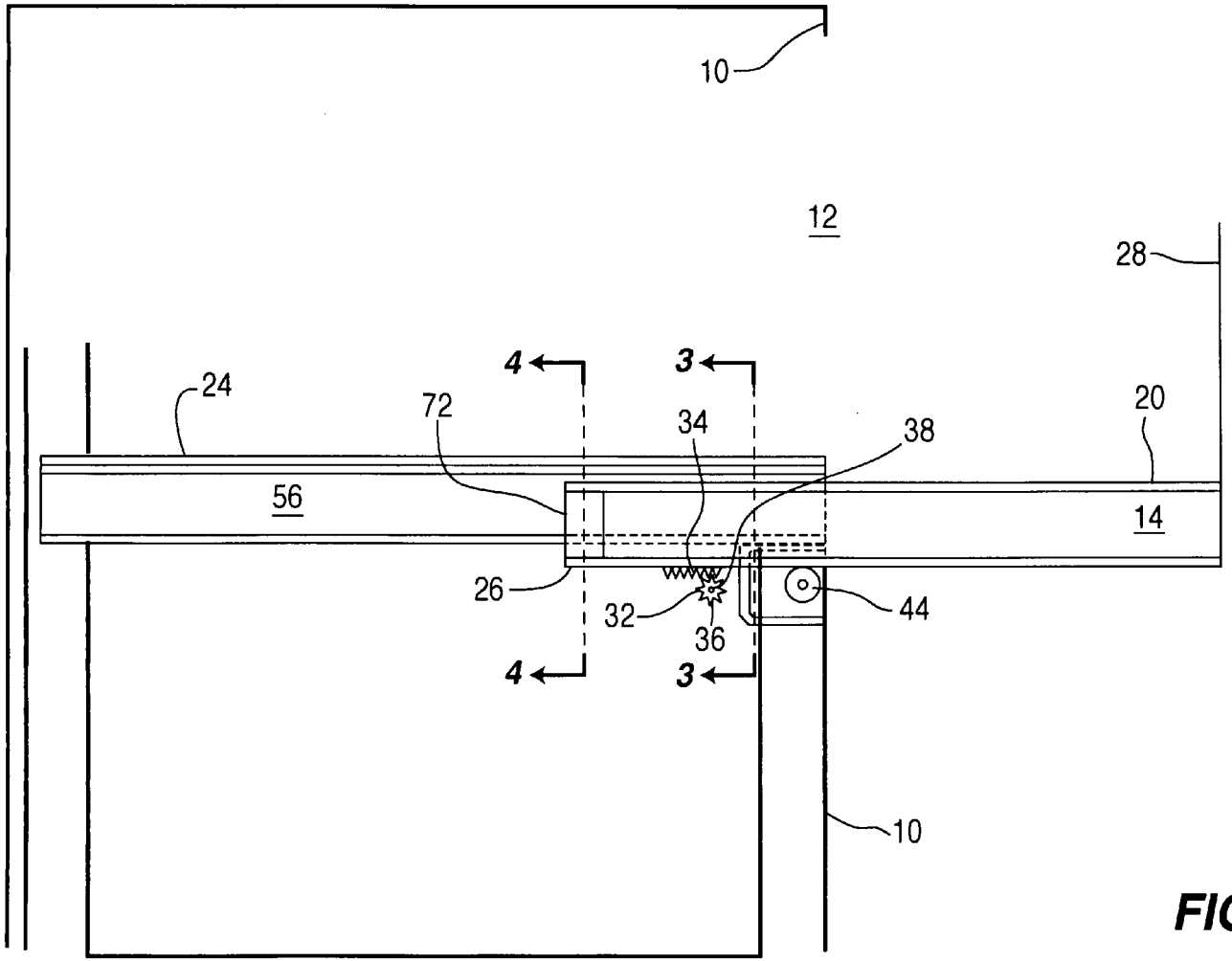
FIG. 2 is a side plan view of an embodiment of the building construction apparatus of the present invention shown with the shuttle in the extended position.
Figure 3:
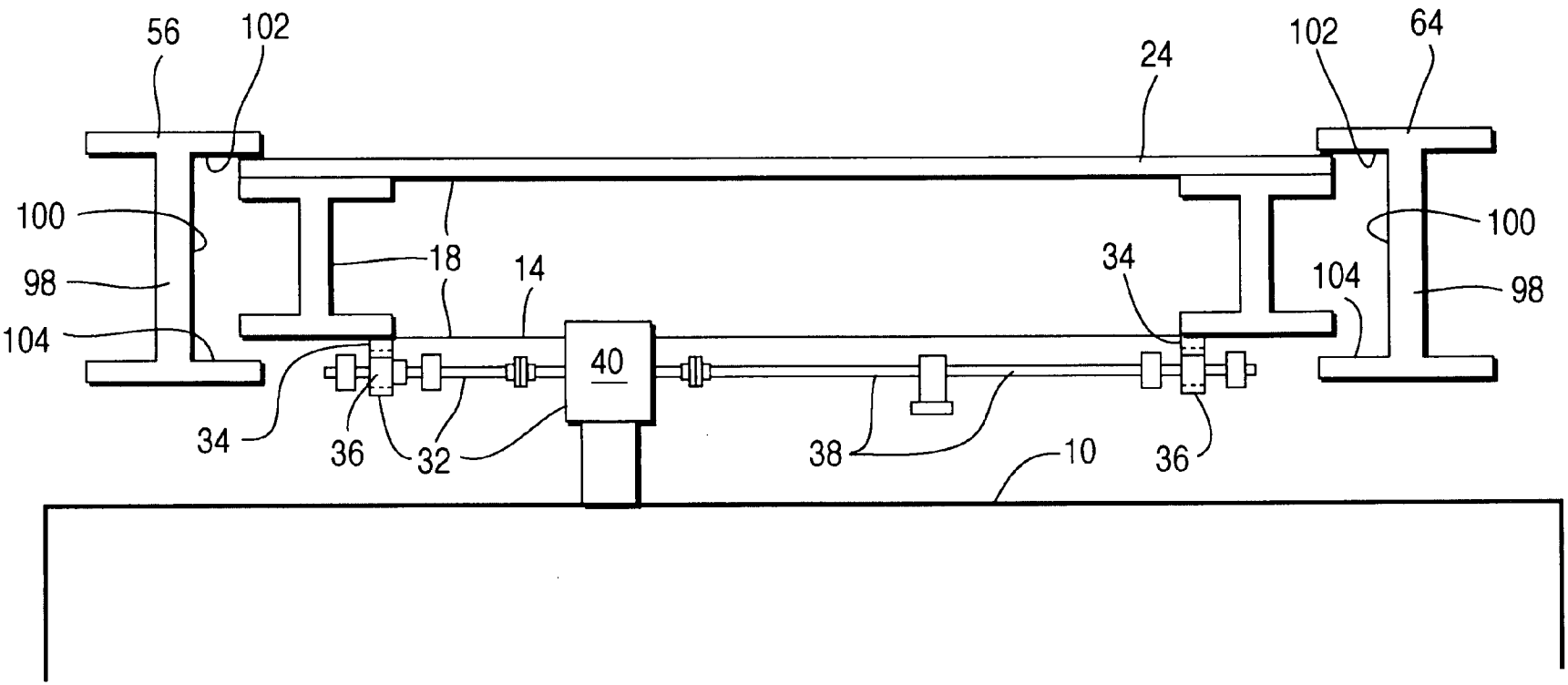
FIG. 3 is a cross-sectional view of the embodiment shown in FIG. 2 along lines 3—3 illustrating the drive mechanism and a cross section of the shuttle frame and I-beam support members.
Figure 4:
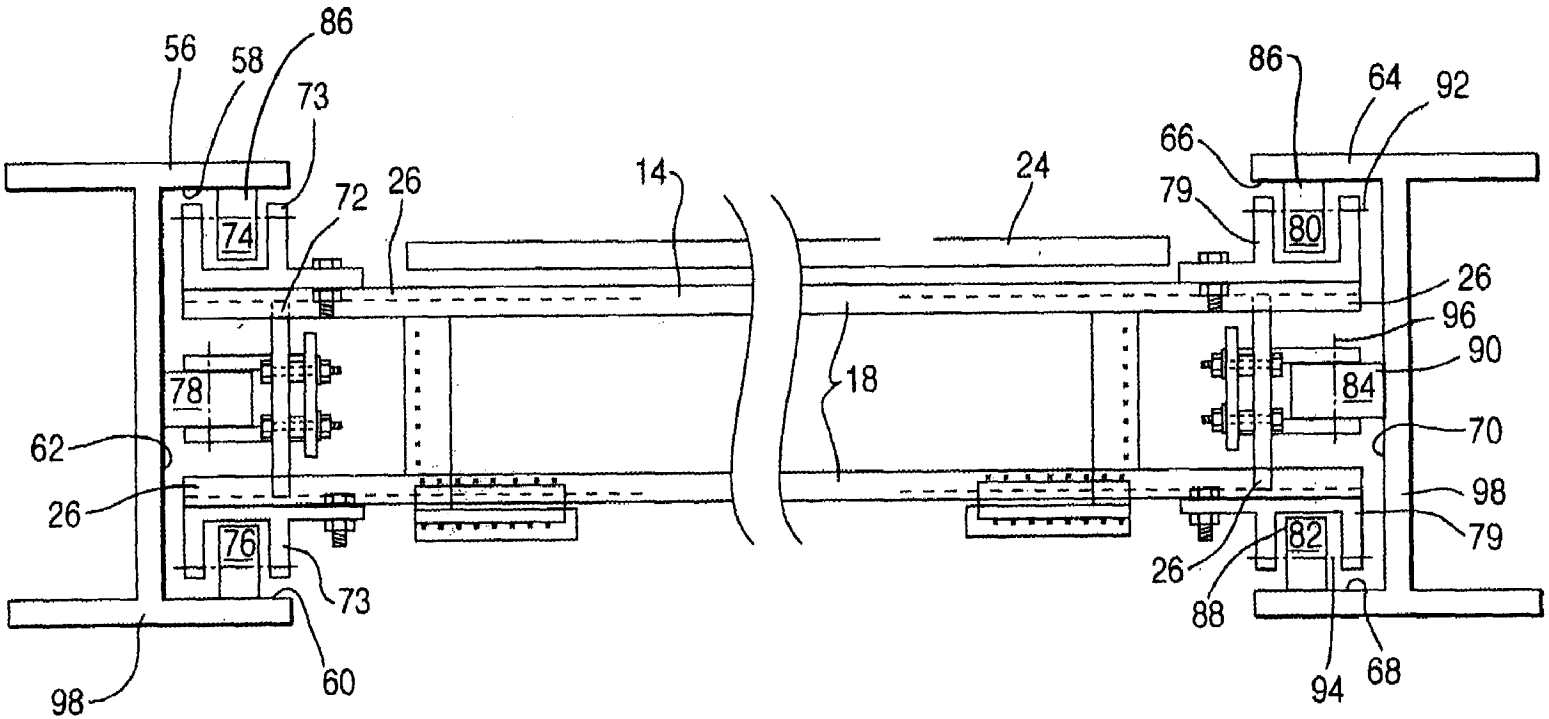
FIG. 4 is a side cross-sectional view of FIG. 2 along lines 4—4 illustrating an embodiment of the tail support member and first and second support carriages with upper, lower and lateral rollers shown thereon as bearings and guides.

Support of the shuttle tail member 26 is achieved by the inclusion of a stationary support means in the construction of the stationary building structure 10. First stationary support 56 and second stationary support 64 primarily comprise I-beam support beams 98 extending generally perpendicularly with respect to the plane of the sidewall opening 12. These members are best shown in FIGS. 2, 3 and 4. The configuration of the first stationary support 56 and the second stationary support 64 is primarily that of an I-beam 98. The I-beam itself includes a vertical panel member 100 as well as a top horizontal panel member 102 as well as a bottom horizontal panel member 104. Thus the three panels, 100, 102, and 104, define the shape of the I-beam 98.

Preferably the I-beams are used as the first stationary support 56 as well as the second stationary support 64. First stationary support 56 will then define a first upper support wall 58 and first lower support wall 60 with a first lateral support wall 62 extending therebetween and thereby defining three walls in an I-beam shape. In a similar manner the second stationary support 64 will define a second upper support wall 66 and a second lower support wall 68 with a second lateral support wall 70 extending therebetween thereby defining an overall I-beam construction for the second stationary support member 64 also. The first and second stationary supports 56 and 64 are preferably spaced apart from one another as shown best in FIG. 3 to define therebetween a movement and retaining channel within which the shuttle section 14 is movable to facilitate relocation thereof between the extended position 20 and the retracted position 22.

To facilitate the relative movement between the shuttle section 14 and the first and second stationary support members 56 and 64 a tail support member 72 will preferably be secured with respect to the shuttle tail member 26 of the present invention. In this embodiment the tail support member 72 is positioned with respect to the endmost portion of the shuttle tail member 26. Preferably a first support carriage 73 is positioned on one end of the tail support member 72 adjacent to the first stationary support 56. This first support carriage 73 will include a first upper bearing comprising preferably a first upper roller which is rotatably mounted with respect to the first support carriage 73 and is brought into abutment with respect to the first upper support wall 58. Similarly a first lower bearing 76 will be rotatably mounted with respect to the first support carriage 73 and in abutment with respect to the first lower support wall 60 to facilitate relative movement between the shuttle section 14 and the first stationary support 56. Also a first lateral bearing preferably also including a roller will be rotatably mounted with respect to the first support carriage 73 and will be in abutment with respect to the first lateral support wall 62. In this manner these three bearings preferably taking the form of rollers will retain the position of the tail support member 72 and the shuttle tail member 26 fixedly secured thereto relative to the shuttle section 14 as it moves between the extended position 20 and the retracted position 22.

In a similar manner the opposite lateral side of the tail support member 72 can include a second support carriage 79. This second support carriage 79 can include a second upper bearing 80 as well as a second lower bearing 82 and a second lateral bearing 84 all of which can be rollers mounted with respect to the second support carriage 79 similar to the mounting of the first rollers 74, 76 and 78 relative to the first support carriage 73. The second upper bearing 80 will preferably be rotatably mounted with respect to the carriage and in abutment with respect to the second upper support wall 66 for movement thereagainst. Similarly the second lower bearing 82 will be rotatably mounted with respect to the second support carriage 79 and will be in abutment with respect to the second lower support wall 68 to facilitate relative movement thereagainst. Finally the second lateral bearing 84 will be rotatably mounted with respect to the second support carriage 79 and will be in abutment with respect to the second lateral support wall 70. In this manner the three bearings or rollers supported by the first support carriage 73 and the second support carriage 79 will facilitate movability of the tail support member 72 and the shuttle section 14 fixedly secured thereto relative to the first stationary support 56 and the second stationary support 64 of the stationary building structure 10 in such a manner as to maintain alignment and to only allow movement of the shuttle section 14 in a direction perpendicularly with respect to the side wall opening 12. Thus the shuttle tail member 26 will be prevented from flexing in the vertical direction or the laterally horizontal direction as it moves between the positions 20 and 22.

In the preferred configuration the upper rollers 86 of the first upper bearing 74 and the second upper bearing 80 will have an upper axis 92 of rotation in the horizontally extending direction. Similarly in the preferred configuration the lower rollers 88 of the first lower bearing 76 and the second lower bearing 82 will have the axis of rotation thereof oriented in a horizontally extending direction. However, in the preferred configuration shown in the figures herein, the preferred configuration of the lateral rollers 90 utilized in the first lateral bearing 78 and the second lateral bearing 84 will be oriented in a vertically extending axis of rotation 96. Thus the axis of rotation of the first and second upper bearings 74 and 80 will extend horizontally as will the lower axis of rotation 94 of the first lower bearing 76 and the second lower bearing 82 but the axis of rotation of the lateral rollers 96 will be oriented approximately vertically.

Figure 6:
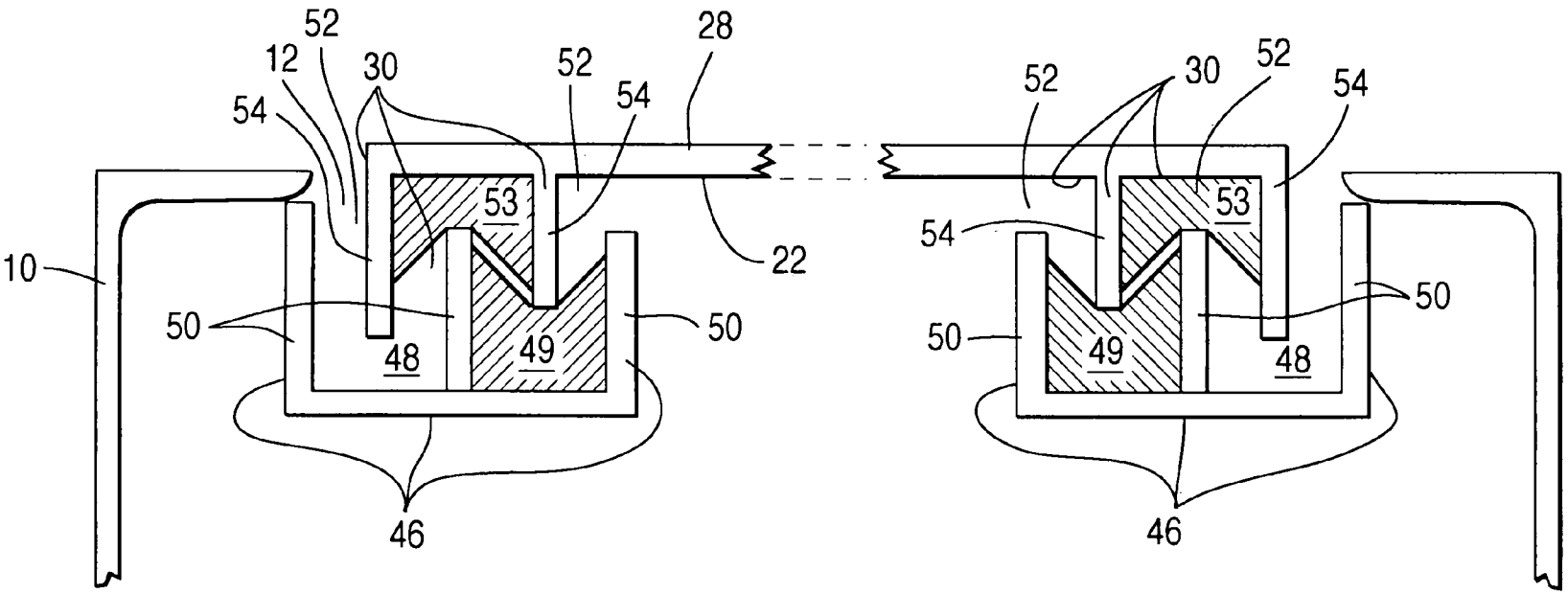
FIG. 6 is a cross-sectional illustration of the stationary wall seal and the outer wall seal shown in engagement with respect to one another with the shuttle section located in the retracted position.

One of the important aspects of the present invention is to achieve a firm sealing between the outer shuttle wall 28 and the stationary building structure 10 in the area immediately around the sidewall opening 12. This is achieved by having a complementary relationship between the outer wall seal 30 and the stationary wall seal 46. This is achieved by defining stationary wall seal 46 to include one or more stationary receiving channels 48 along with one or more stationary protruding ribs 50. In a similar manner the outer wall seal 10 will preferably include one or more outer receiving channels 52 and one or more outer protruding ribs 54. In the preferred configuration shown by the cross-sections shown in FIG. 6 the stationary protruding ribs 50 will be adapted to extend into the outer receiving channels 52. At the same time the outer protruding ribs 54 will be adapted to extend into the stationary receiving channels 48. This neutral engaging complementary sealing means is effective in preventing any leakage between the stationary building structure 10 and the outer shuttle wall 28 when the shuttle section 14 is in the retracted position. To facilitate movement of the stationary protruding rib 50 into the outer receiving channel 52 a V-shaped outer guide 53 may be positioned therewithin. This V-shaped outer guide 53 will facilitate in guiding the stationary protruding rib 50 into a correctly centered position within the outer receiving channel 52 for engagement therewith. In a similar manner a V-shaped stationary guide 49 will preferably be positioned within the stationary receiving channel 48 for the purpose of guiding the outer protruding rib 54 thereinto and centering them with respect to one another. In this manner a mutual interengagement between the ribs and channels of the respective portions will be achieved for effective sealing therebetween.

Figure 5:
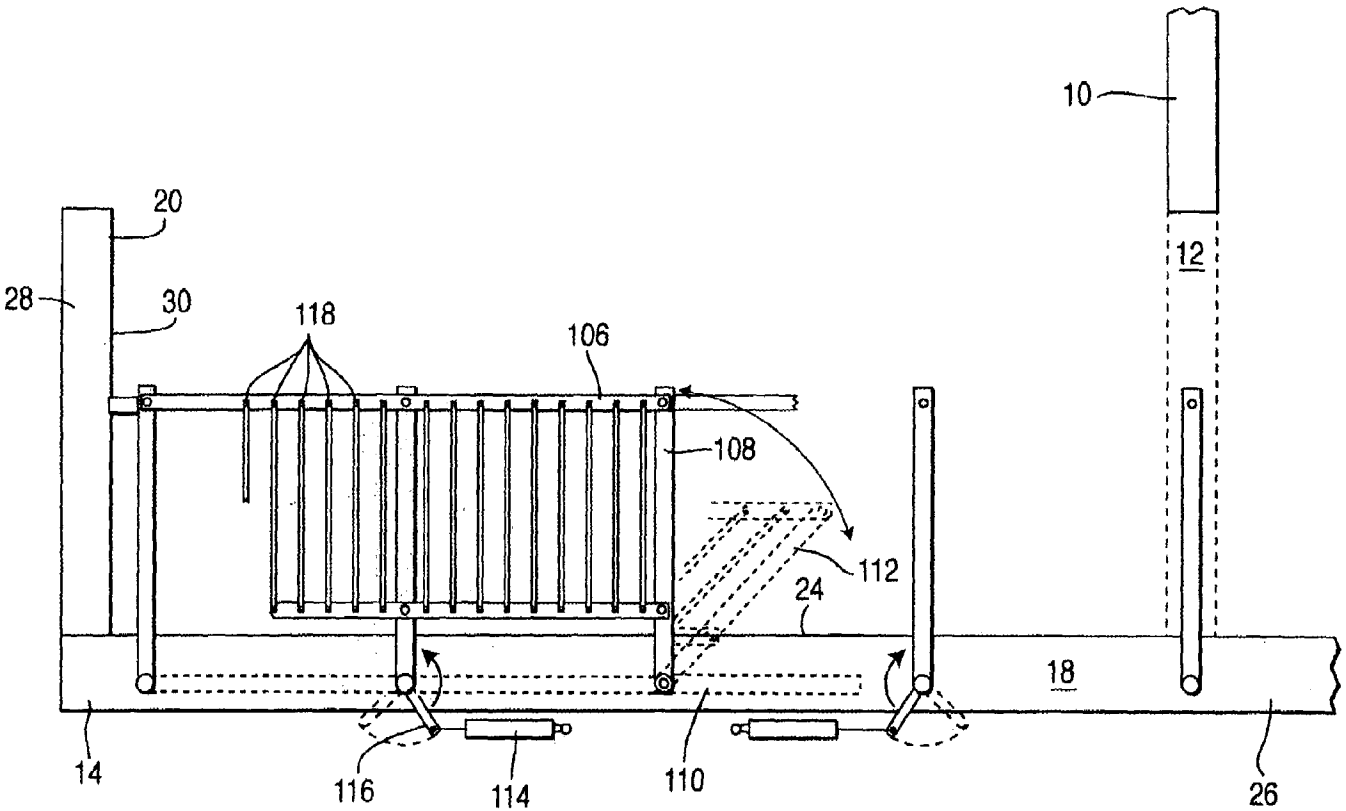
FIG. 5 is a side plan view of the embodiment shown in FIG. 1 illustrating the guard rail shown in the deployed position, collapsed position and in the intermediate position therebetween.

Another important aspect of the present invention is the guard rail means 106 as shown best in FIGS. 1 and 5. Building codes require guard rails for unprotected elevated walking surfaces such as decks, porches or the like and this also applies to the shuttle floor surface 24 of the shuttle section 14 of the present invention. In those areas at the edges of the shuttle floor surface 24 where a wall is not included a guard rail should be positionable. In the present invention no guard rail is required on the outermost edge of the shuttle floor surface 24 since the outer shuttle wall 28 extends upwardly therefrom. Also as shown in FIG. 1 the far edge of the shuttle floor surface 24 does not require a guard rail since the lateral shuttle wall 42 extends upwardly therefrom. However the edge of the shuttle floor surface 24 in the foreground of FIG. 1 would require some type of protective guard rail. FIG. 1 shows this guard rail in the fully deployed position.

It is also important that the guard rail not be in the deployed position when the shuttle section 14 is in the retracted position 22. As such, the guard rail means 106 of the present invention is deemed to be collapsible between a collapsed position 110 and a deployed position 108. FIG. 5 shows the fully deployed position 108 and the fully collapsed position 110 in full outline and shows the intermediate position 112 for the guard rail when moving between the deployed position 108 and collapsed position 110 in dotted outline. This collapsibility is achieved by providing pivotal interconnections 118 between the vertically extending posts and the horizontally extending rails. These pivotal connections allow the guard rail 106 to be held at an extended position while at the same time being racked sufficiently to extend horizontally in a fully collapsed position 110. As shown in FIG. 5 the fully collapsed position extends horizontally beneath the shuttle floor surface 24. This operation is achieved by the inclusion of a control arm 116 with an actuator 114 pivotally attached thereto. Activation of the actuator 114 causes the control arm 116 to pivot causing movement of the guard rail 106 between the deployed and collapsed positions 108 and 110 as fully shown in FIG. 5. In the preferred configuration of the present invention the guard rail 106 will be moved to the fully deployed position responsive to initiation of movement of the shuttle section 14 toward the extended position. Also the guard rail 106 will initiate movement from the deployed position 108 to the collapsed position 110 responsive to the shuttle section 14 reaching the fully retracted position 22. Thus at all times when the shuttle section 14 is moving between positions or stationary at the fully extended position 20, the guard rail 106 will be fully deployed for the purposes of safety.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A building construction apparatus comprising:

A. a stationary building structure defining a sidewall opening means therewithin, said stationary building structure also including a stationary support means including:

(1) an upper support wall means fixedly secured to said stationary building structure;

(2) a lower support wall means fixedly secured to said stationary building structure at a position below said upper support wall means; and (3) a lateral support wall means extending generally vertically between said upper support wall means and said lower support wall means;

B. a shuttle section movably secured to said stationary building structure and extendable outwardly therefrom through said sidewall opening means defined therein to selectively provide an open air living area, said shuttle section comprising:

(1) a shuttle frame means movably secured to said stationary building structure and adapted to be extendable generally horizontally outwardly therefrom through said sidewall opening means thereof to an extended position with respect thereto for open air exposure outside of said stationary building structure, said shuttle frame means also being movable into said stationary building structure through said sidewall opening means thereof to a retracted position to facilitate conventional use of said stationary building structure, said stationary support means of said stationary building structure adapted to facilitate control of movement of said shuttle frame means between the extended position and the retracted position;

(2) a shuttle floor surface fixedly secured to and positioned upon said shuttle frame means and defining a walking surface thereupon;

(3) a shuttle tail member fixedly secured to said shuttle frame means and movable therewith, said shuttle tail member adapted to extending into said stationary building structure from said shuttle frame means responsive to positioning thereof at the retracted position and at the extended position and during movement therebetween, said shuttle tail member being movable along with said shuttle frame means relative to said stationary building structure and extending thereinto in order to facilitating supporting of said shuttle frame means;

(4) an outer shuttle wall means extending upwardly from said shuttle frame means and adapted to extend across the sidewall opening of said stationary building structure responsive to said shuttle frame means being located in the retracted position;

(5) an outer wall sealing means positioned peripherally around said outer shuttle wall means for sealing thereof with respect to said stationary building structure around said sidewall opening means defined therein responsive to said shuttle section being in the retracted position;

(6) a drive mechanism operatively connected with respect to said shuttle frame means for selectively urging movement thereof between the retracted position and the extended position, respectively;

(7) a tail support member fixedly secured to said shuttle tail member to be movable therewith and to facilitate support of said shuttle tail member responsive to positioning thereof at the extended position and at the retracted position and during movement therebetween, said tail support member including:

a. an upper bearing means extending upwardly from said tail support member and adapted to abut and follow said upper support wall means to facilitate supporting of said shuttle section during movement thereof between the extended position and the retracted position;

b. a lower bearing means extending downwardly from said tail support member and adapted to abut and follow said lower support wall means to facilitate supporting of said shuttle section during movement thereof between the extended position and the retracted position; and c. a lateral bearing means extending laterally outwardly from said tail support member and adapted to engage and follow said lateral support wall means to facilitate lateral support of said shuttle section during movement thereof between the extended position and the retracted position.

2. A building construction apparatus as defined in claim 1 further comprising a lateral shuttle wall means extending upwardly from said shuttle frame means and fixedly secured thereto for simultaneously moving between the retracted position and the extended position therewith, said lateral shuttle wall means being positioned adjacent to said outer wall means and also being movable therewith.

3. A building construction apparatus as defined in claim 1 further comprising a primary bearing means mounted on said stationary building structure adjacent said sidewall opening means at a location beneath said shuttle frame means for supporting thereof relative to said stationary building structure and to facilitate movement thereof between the extended position and the retracted position.

4. A building construction apparatus as defined in claim 3 wherein said primary bearing means comprises a primary roller means rotatably secured to said stationary building structure and in abutment with respect to said shuttle frame means located thereabove for guiding and supporting movement thereof between the extended position and the retracted position, respectively.

5. A building construction apparatus as defined in claim 1 further comprising a stationary wall sealing means extending peripherally around said sidewall opening means on said stationary building structure which is configured to complement and engage said outer wall sealing means to facilitate sealing between said outer shuttle wall means and said stationary building structure surrounding said sidewall opening means thereof.

6. A building construction apparatus as defined in claim 1 wherein said upper bearing means comprises an upper roller means rotatably mounted with respect to said tail support member and in abutment with respect to said upper support wall means and wherein said lower bearing means comprises a lower roller means rotatably mounted with respect to said tail support member and in abutment with respect to said lower support wall means and wherein said lateral bearing means comprises a lateral roller means rotatably mounted with respect to said tail support member and in abutment with respect to said lateral support wall means.

7. A building construction apparatus as defined in claim 6 wherein said upper roller means defines an upper axis of rotation extending generally horizontally and said lower roller means defines a lower axis of rotation extending generally horizontally.

8. A building construction apparatus as defined in claim 6 wherein said lateral roller means defines a lateral axis of rotation extending generally vertically.

9. A building construction apparatus as defined in claim 1 wherein said stationary building structure includes an I-beam support beam extending therealong which includes:

A. a vertical panel member defining said lateral support wall means extending therealong;

B. a top horizontal panel member being integral with the upper portion of said vertically extending panel member and defining said upper support wall means extending therealong; and C. a bottom horizontal panel member being integral with the lower portion of said vertical panel member and defining said lower support wall means extending therealong.

10. A building construction apparatus as defined in claim 9 wherein said I-beam support beam is fixedly secured to said stationary building structure in an orientation extending perpendicularly with respect to said sidewall opening means defined therein.

11. A building construction apparatus as defined in claim 1 further comprising a collapsible guard rail means attached to said shuttle frame means and being movable to a deployed position responsive to movement of said shuttle frame means from the retracted position toward the extended position and being movable to a storage position responsive to movement of said shuttle frame means to the retracted position.

12. A building construction apparatus as defined in claim 1 wherein said stationary building structure includes A. a first stationary support means located adjacent said sidewall opening means; and B. a second stationary support means located adjacent said sidewall opening means and positioned spatially disposed oppositely from said first stationary support means relative to said sidewall opening means to facilitate controlling of movement of said shuttle frame means between the extended position and the retracted position.

13. A building construction apparatus as defined in claim 12 wherein said first stationary support means includes:

A. a first upper support wall means fixedly secured to said stationary building structure;

B. a first lower support wall means fixedly secured to said stationary building structure at a position below said first upper support wall means; and C. a first lateral support wall means extending generally vertically between said first upper support wall means and said first lower support wall means.

14. A building construction apparatus as defined in claim 13 wherein said second stationary support means includes:

A. a second upper support wall means fixedly secured to said stationary building structure;

B. a second lower support wall means fixedly secured to said stationary building structure at a position below said second upper support wall means; and C. a second lateral support wall means extending generally vertically between said second upper support wall means and said second lower support wall means.

15. A building construction apparatus as defined in claim 14 further comprising a tail support member fixedly secured to said shuttle tail member to be movable therewith and to facilitate support thereof during movement between the extended position and the retracted position, said tail support member including:

A. a first support carriage means adjacent said first stationary support means and further including;

(1) a first upper bearing means extending upwardly from said tail support member and adapted to engage and follow said first upper support wall means to facilitate supporting of said shuttle section during movement thereof between the extended position and the retracted position;

(2) a first lower bearing means extending downwardly from said shuttle tail member and adapted to engage and follow said first lower support wall means to facilitate supporting of said shuttle section during movement thereof between the extended position and the retracted position;

(3) a first lateral bearing means extending laterally outwardly from said tail support member and adapted to engage and follow said first lateral support wall means to facilitate lateral support of said shuttle section during movement thereof between the extended position and the retracted position; and B. a second support carriage means adjacent said second stationary support means and further including;

(1) a second upper bearing means extending upwardly therefrom and adapted to engage and follow said second upper support wall means to facilitate supporting of said shuttle section during movement thereof between the extended position and the retracted position;

(2) a second lower bearing means extending downwardly from said tail support member and adapted to engage and follow said second lower support wall means to facilitate supporting of said shuttle section during movement thereof between the extended position and the retracted position; and (3) a second lateral bearing means extending laterally outwardly from said tail support member and adapted to engage and follow said second lateral support wall means to facilitate lateral support of said shuttle section during movement thereof between the extended position and the retracted position.

16. A building construction apparatus as defined in claim 1 wherein said drive mechanism comprises:

A. a rack gear means secured to said shuttle frame means and extending therealong;

B. a drive gear means movably secured to said stationary building structure and positioned in engagement with respect to said rack gear means to cause driving movement thereof and driving movement of said shuttle frame means selectively between the extended position and the retracted position, respectively;

C. a driveshaft means attached to said drive gear means for selectively urging rotational movement thereof; and D. a drive means fixedly secured to said stationary building structure and operatively attached to said driveshaft means for urging rotational movement thereof, said drive means being responsive to selective operation thereof to rotate said drive shaft means and said drive gear means for powering movement of said rack gear means to cause said shuttle section to selectively move between the retracted position and the extended position, respectively.

17. A building construction apparatus as defined in claim 5 wherein said stationary wall sealing means defines at least one stationary receiving channel means extending therearound and includes at least one stationary protruding rib means extending therearound and wherein said outer wall sealing means defines at least one outer receiving channel means extending therearound and includes at least one outer protruding rib means extending therearound, said stationary receiving channel means adapted to engage said outer protruding rib means therein and said outer receiving channel means adapted to engage said stationary protruding rib means therein to facilitate sealing engagement between said stationary wall sealing means and said outer wall sealing means responsive to said shuttle section being located in the retracted position.

18. A building construction apparatus as defined in claim 17 further including a V-shaped stationary guide means positioned within said stationary receiving channel means to facilitate in guiding sealing engagement between said outer protruding rib means and said stationary receiving channel means responsive to movement of said shuttle frame means to the retracted position, and further including a V-shaped outer guide means positioned within said outer receiving channel means to facilitate in guiding sealing engagement between said stationary protruding rib means and said outer receiving channel means responsive to movement of said shuttle frame means to the retracted position.

19. A building construction apparatus as defined in claim 1 wherein said shuttle frame means and said shuttle tail member are formed as a single integrally formed unit.

20. A building construction apparatus comprising:

A. a stationary building structure defining a sidewall opening means therewithin, said stationary building structure including a stationary support means therein to facilitate control of movement of said shuttle frame means between the extended position and the retracted position, said stationary support means including:

(1) an upper support wall means fixedly secured to said stationary building structure;

(2) a lower support wall means fixedly secured to said stationary building structure at a position below said upper support wall means; and (3) a lateral support wall means extending generally vertically between said upper support wall means and said lower support wall means;

B. a shuttle section movably secured to said stationary building structure and extendable outwardly therefrom through said sidewall opening means defined therein to selectively provide an open air living area, said shuttle section comprising:

(1) a shuttle frame means movably secured to said stationary building structure and adapted to be extendable generally horizontally outwardly therefrom through said sidewall opening means thereof to an extended position with respect thereto for open air exposure outside of said stationary building structure, said shuttle frame means also being movable into said stationary building structure through said sidewall opening means thereof to a retracted position to facilitate conventional use of said stationary building structure;

(2) a shuttle floor surface fixedly secured to and positioned upon said shuttle frame means and defining a walking surface thereupon;

(3) a shuttle tail member being integrally formed with said shuttle frame means to be fixedly secured thereto and movable therewith, said shuttle tail member adapted to extending into said stationary building structure from said shuttle frame means responsive to positioning thereof at the retracted position and at the extended position and during movement therebetween, said shuttle tail member being movable along with said shuttle frame means relative to said stationary building structure and extending thereinto in order to facilitating supporting of said shuttle frame means;

(4) an outer shuttle wall means extending upwardly from said shuttle frame means and adapted to extend across the sidewall opening of said stationary building structure responsive to said shuttle frame means being located in the retracted position;

(5) an outer wall sealing means positioned peripherally around said outer shuttle wall means for sealing thereof with respect to said stationary building structure around said sidewall opening means defined therein responsive to said shuttle section being in the retracted position;

(6) a drive mechanism operatively connected with respect to said shuttle frame means for selectively urging movement thereof between the retracted position and the extended position, respectively, said drive mechanism comprising:

a. a rack gear means secured to said shuttle frame means and extending therealong;

b. a drive gear means movably secured to said stationary building structure and positioned in engagement with respect to said rack gear means to cause driving movement thereof and driving movement of said shuttle frame means selectively between the extended position and the retracted position, respectively;

c. a driveshaft means attached to said drive gear means for selectively urging rotational movement thereof;

d. a drive means fixedly secured to said stationary building structure and operatively attached to said driveshaft means for urging rotational movement thereof, said drive means being responsive to selective operation thereof to rotate said drive shaft means and said drive gear means for powering movement of said rack gear means to cause said shuttle section to selectively move between the retracted position and the extended position, respectively;

(7) a tail support member fixedly secured to said shuttle tail member to be movable therewith and to facilitate support of said shuttle tail member responsive to positioning thereof at the extended position and at the retracted position and during movement therebetween, said tail support member including:

a. an upper bearing means extending upwardly from said tail support member and adapted to abut and follow said upper support wall means to facilitate supporting of said shuttle section during movement thereof between the extended position and the retracted position, said upper bearing means comprising an upper roller means rotatably mounted with respect to said tail support member and in abutment with respect to said upper support wall means;

b. a lower bearing means extending downwardly from said tail support member and adapted to abut and follow said lower support wall means to facilitate supporting of said shuttle section during movement thereof between the extended position and the retracted position, said lower bearing means comprising a lower roller means rotatably mounted with respect to said tail support member and in abutment with respect to said lower support wall means;

c. a lateral bearing means extending laterally outwardly from said tail support member and adapted to engage and follow said lateral support wall means to facilitate lateral support of said shuttle section during movement thereof between the extended position and the retracted position, said lateral bearing means comprising a lateral roller means rotatably mounted with respect to said tail support member and in abutment with respect to said lateral support wall means;

C. a primary bearing means mounted on said stationary building structure adjacent said sidewall opening means at a location beneath said shuttle frame means for supporting thereof relative to said stationary building structure and to facilitate movement thereof between the extended position and the retracted position;

D. a stationary wall sealing means extending peripherally around said sidewall opening means on said stationary building structure which is configured to complement and engage said outer wall sealing means to facilitate sealing between said outer shuttle wall means and said stationary building structure surrounding said sidewall opening means thereof; and E. a collapsible guard rail means attached to said shuttle frame means and being movable to a deployed position responsive to movement of said shuttle frame means from the retracted position toward the extended position and being movable to a storage position responsive to movement of said shuttle frame means to the retracted position.

21. A building construction apparatus comprising:

A. a stationary building structure defining a sidewall opening means therewithin, said stationary building structure including:

(1) a stationary support means therein to facilitate control of movement of said shuttle frame means between the extended position and the retracted position, said stationary support means including:

a. an upper support wall means fixedly secured to said stationary building structure;

b. a lower support wall means fixedly secured to said stationary building structure at a position below said upper support wall means; and c. a lateral support wall means extending generally vertically between said upper support wall means and said lower support wall means;

(2) an I-beam support beam therein fixedly secured thereto and extending perpendicularly with respect to said sidewall opening means, said I-beam support beam including:

a. a vertical panel member defining said lateral support wall means extending therealong;

b. a top horizontal panel member being integral with the upper portion of said vertically extending panel member and defining said upper support wall means extending therealong;

c. a bottom horizontal panel member being integral with the lower portion of said vertical panel member and defining said lower support wall means extending therealong;

B. a shuttle section movably secured to said stationary building structure and extendable outwardly therefrom through said sidewall opening means defined therein to selectively provide an open air living area, said shuttle section comprising:

(1) a shuttle frame means movably secured to said stationary building structure and adapted to be extendable generally horizontally outwardly therefrom through said sidewall opening means thereof to an extended position with respect thereto for open air exposure outside of said stationary building structure, said shuttle frame means also being movable into said stationary building structure through said sidewall opening means thereof to a retracted position to facilitate conventional use of said stationary building structure;

(2) a shuttle floor surface fixedly secured to and positioned upon said shuttle frame means and defining a walking surface thereupon;

(3) a shuttle tail member being integrally formed with said shuttle frame means to be fixedly secured thereto and movable therewith, said shuttle tail member adapted to extending into said stationary building structure from said shuttle frame means responsive to positioning thereof at the retracted position and at the extended position and during movement therebetween, said shuttle tail member being movable along with said shuttle frame means relative to said stationary building structure and extending thereinto in order to facilitating supporting of said shuttle frame means;

(4) an outer shuttle wall means extending upwardly from said shuttle frame means and adapted to extend across the sidewall opening of said stationary building structure responsive to said shuttle frame means being located in the retracted position;

(5) an outer wall sealing means positioned peripherally around said outer shuttle wall means for sealing thereof with respect to said stationary building structure around said sidewall opening means defined therein responsive to said shuttle section being in the retracted position, said outer wall sealing means defining at least one outer receiving channel means extending therearound and including at least one outer protruding rib means extending therearound, said outer wall sealing means including a V-shaped outer guide means positioned within said outer receiving channel means to facilitate in guiding sealing engagement therewith;

(6) a drive mechanism operatively connected with respect to said shuttle frame means for selectively urging movement thereof between the retracted position and the extended position, respectively, said drive mechanism comprising:

a. a rack gear means secured to said shuttle frame means and extending therealong;

b. a drive gear means movably secured to said stationary building structure and positioned in engagement with respect to said rack gear means to cause driving movement thereof and driving movement of said shuttle frame means selectively between the extended position and the retracted position, respectively;

c. a driveshaft means attached to said drive gear means for selectively urging rotational movement thereof;

d. a drive means fixedly secured to said stationary building structure and operatively attached to said driveshaft means for urging rotational movement thereof, said drive means being responsive to selective operation thereof to rotate said drive shaft means and said drive gear means for powering movement of said rack gear means to cause said shuttle section to selectively move between the retracted position and the extended position, respectively;

(7) a tail support member fixedly secured to said shuttle tail member to be movable therewith and to facilitate support of said shuttle tail member responsive to positioning thereof at the extended position and at the retracted position and during movement therebetween, said tail support member including:

a. an upper bearing means extending upwardly from said tail support member and adapted to abut and follow said upper support wall means to facilitate supporting of said shuttle section during movement thereof between the extended position and the retracted position, said upper bearing means comprising an upper roller means rotatably mounted with respect to said tail support member and in abutment with respect to said upper support wall means, said upper roller means defining an upper axis of rotation extending generally horizontally;

b. a lower bearing means extending downwardly from said tail support member and adapted to abut and follow said lower support wall means to facilitate supporting of said shuttle section during movement thereof between the extended position and the retracted position, said lower bearing means comprising a lower roller means rotatably mounted with respect to said tail support member and in abutment with respect to said lower support wall means, said lower roller means defining a lower axis of rotation extending generally horizontally;

c. a lateral bearing means extending laterally outwardly from said tail support member and adapted to engage and follow said lateral support wall means to facilitate lateral support of said shuttle section during movement thereof between the extended position and the retracted position, said lateral bearing means comprising a lateral roller means rotatably mounted with respect to said tail support member and in abutment with respect to said lateral support wall means, said lateral roller means defining a lateral axis of rotation extending generally vertically;

C. a primary bearing means mounted on said stationary building structure adjacent said sidewall opening means at a location beneath said shuttle frame means for supporting thereof relative to said stationary building structure and to facilitate movement thereof between the extended position and the retracted position, said primary bearing means including a primary roller means rotatably secured to said stationary building structure and in abutment with respect to said shuttle frame means located thereabove for guiding and supporting movement thereof between the extended position and the retracted position, respectively;

D. a stationary wall sealing means extending peripherally around said sidewall opening means on said stationary building structure which is configured to complement and engage said outer wall sealing means to facilitate sealing between said outer shuttle wall means and said stationary building structure surrounding said sidewall opening means thereof, said stationary wall sealing means defining a stationary receiving channel means extending therearound and including at least one stationary protruding rib means extending therearound, said stationary receiving channel means adapted to engage said outer protruding rib means therewithin and said outer receiving channel means adapted to engage said stationary protruding rib means therewithin to facilitate sealing engagement between said stationary wall sealing means and said outer wall sealing means responsive to said shuttle section being located in the retracted position, said stationary wall sealing means including a V-shaped stationary guide means positioned within said stationary receiving channel means to facilitate in guiding sealing engagement between said outer protruding rib means and said stationary receiving channel means responsive to movement of said shuttle frame means to the retracted position, said stationary protruding rib means adapted to abut said V-shaped outer guide means to facilitate guiding movement thereof into sealing engagement with respect to said outer receiving channel means;

E. a collapsible guard rail means attached to said shuttle frame means and being movable to a deployed position responsive to movement of said shuttle frame means from the retracted position toward the extended position and being movable to a storage position responsive to movement of said shuttle frame means to the retracted position; and F. a lateral shuttle wall means extending upwardly from said shuttle frame means and fixedly secured thereto for simultaneously moving between the retracted position and the extended position therewith, said first shuttle wall means being positioned adjacent to said outer wall means and also being movable therewith.

* * * * *